United States Patent [19]

McGann, Jr.

[11] 4,067,559

[45] Jan. 10, 1978

[54] UTENSIL FOR HOLDING BOILED EGGS

[76] Inventor: John J. McGann, Jr., P.O. Box 991, New Smyrna Beach, Fla. 32069

[21] Appl. No.: 752,923

[22] Filed: Dec. 21, 1976

[51] Int. Cl.[2] ..... B25B 11/00

[52] U.S. Cl. ..... 269/13; 269/296; 269/321 W

[58] Field of Search ..... 269/13, 289, 296, 302.1, 269/321 W; 99/537

[56] References Cited

U.S. PATENT DOCUMENTS

| | | | |
|---|---|---|---|
| 1,205,993 | 11/1916 | Higert | 269/289 |
| 3,030,994 | 4/1962 | Wysowski | 269/13 |
| 3,116,770 | 1/1964 | Tanuma | 99/537 |
| 3,899,161 | 8/1975 | McGann | 269/13 |

FOREIGN PATENT DOCUMENTS

| | | | |
|---|---|---|---|
| 99,444 | 10/1898 | Germany | 269/286 |

*Primary Examiner*—Robert C. Watson

*Attorney, Agent, or Firm*—Shoemaker and Mattare

[57] ABSTRACT

A utensil for holding boiled eggs to be cut and eaten, includes a base having an annular upper surface, with at least a pair of spaced apart depressions therein each having a shape and size substantially complemental to the shape and size of one end half of an egg, and an upstanding egg support is disposed between the pair of depressions for supporting an egg, whereby when the egg is cut, a half thereof falls into each of the depressions to thus simplify removal of boiled eggs from their shells with little or no loss of yolk, and also providing a holder from which eggs may be eaten directly out of the half shells. The annular surface surrounds a central bowl-shaped depression and channels extend from the depressions in the annular surface to the bowl-shaped depression, whereby egg yolk and the like spilled from cracked or improperly cut eggs can flow or be scooped into the bowl-shaped depression to be eaten, and where the interior of the eggs may be placed for mixing and eating.

6 Claims, 5 Drawing Figures

UTENSIL FOR HOLDING BOILED EGGS

BACKGROUND OF THE INVENTION

This invention represents an improvement over my prior U.S. Pat. No. 3,899,161, issued Aug. 12, 1975, and relates to kitchen utensils, and in particular, relates to a holder for holding and eating eggs and the like whereby the eggs and the like may be cut and a half thereof will fall into a depression in the holder.

A hard boiled egg can be removed from the shell by cracking the shell and peeling it off. However, this is not practical when the egg is hot, since it is difficult to hold. Moreover, a soft boiled egg is difficult to cut according to conventional methods, and a substantial amount of the egg yolk may be lost. If the egg is cooked through so that the yolk is hard, the egg can be cut on a table and the interior of the egg removed with a spoon. However, the egg tends to roll around on the table top and this procedure is thus less than satisfactory.

Some prior art devices provide means for holding boiled eggs while they are being cut. However, if the egg is cracked or improperly cut, some of the yolk may still be lost.

OBJECTS OF THE INVENTION

Accordingly, it is an object of this invention to provide a means of cutting a hard or soft boiled egg and the like so that little or no yolk is lost.

Another object of the invention is to provide a holder for securely holding a hot boiled egg so that the egg may be cut to gain access to the interior thereof with little or no loss of the egg yolk and without requring a hot boiled egg to be held with the fingers.

A further object of the invention is to provide a holder for supporting a boiled egg while it is being cut, and wherein a bowl-shaped depression is provided adjacent the cut egg to catch any yolk which does spill from the egg, and to provide a place to mix the white of the egg and the egg yolk with butter, salt and pepper, if so desired, prior to eating.

DETAILED DESCRIPTION OF THE INVENTION

The utensil or egg holder 10 comprises a one-piece molded or shaped base 11 of metal or plastic or other suitable material having an annular upper surface or wall 12, with two pairs of hemiellipsoidal sockets or depressions 13,14 and 15,16 therein, each of a size and shape such as to receive and hold one end half of an egg or the like therein.

Figure 1:
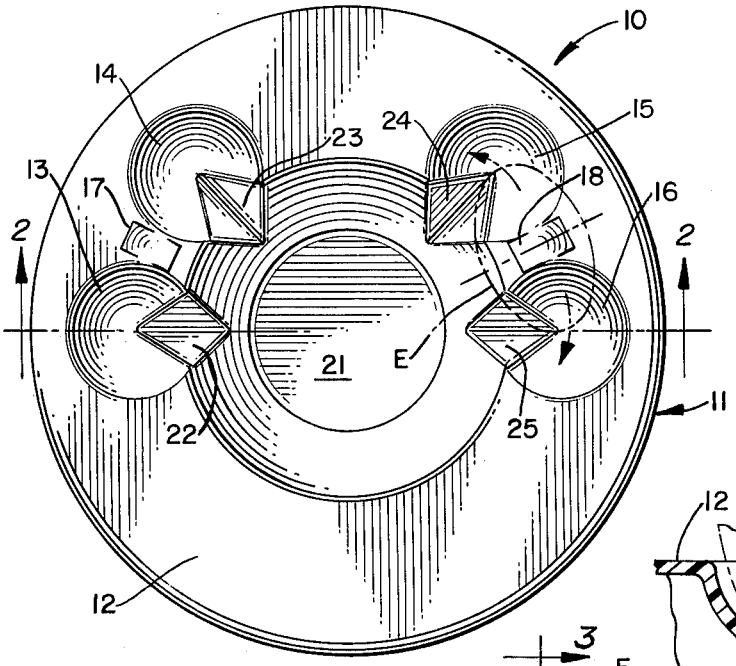
FIG. 1 is a top plan view of the egg holder according to the invention.
Figure 3:
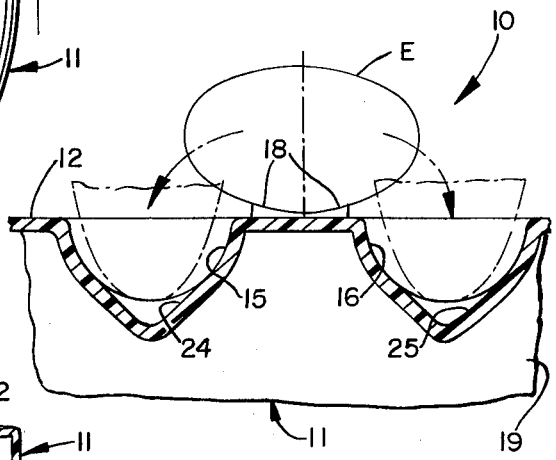
FIG. 3 is an enlarged, fragmentary, sectional view of the egg holding depressions and is taken along line 3—3 in FIG. 2.
Figure 2:
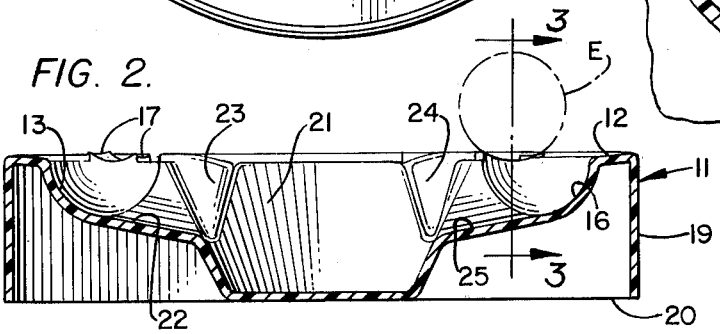
FIG. 2 is a vertical sectional view taken along line 2—2 in FIG. 1.
Figure 4:
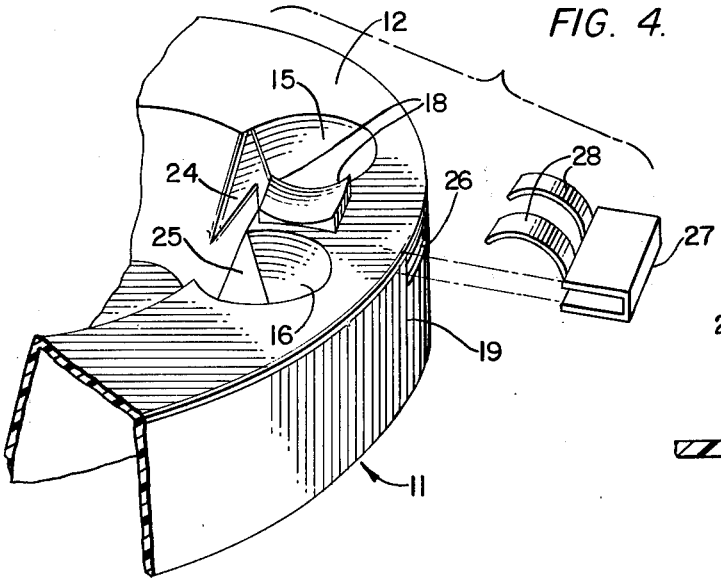
FIG. 4 is a fragmentary, exploded, perspective view of the egg holder of FIG. 1, with an egg holding clip for firmly holding an egg in place while it is being cut.
Figure 5:
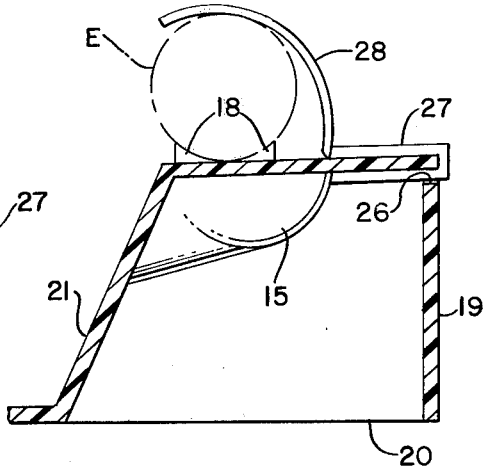
FIG. 5 is a fragmentary view in section, taken along line 5—5 in FIG. 4.

Suitable egg supporting and holding means, such as upstanding projections 17 and 18, extend upwardly from the upper surface 12 closely adjacent to and between the respective pairs of depressions 13,14 and 15,16 and define a cradle on which an egg may be placed and supported for cutting the egg, as indicated in dot and dash lines at E in FIG. 1, whereby each end half of the egg will fall into a respective depression 13,14 and 15,16. Alternatively to this structure, the upstanding prongs as used in prior U.S. Pat. No. 3,899,161 may be used.

The egg holder 10 has a depending, cylindrical skirt 19 at the outer periphery of the annular upper surface or wall 12, and the bottom marginal edge 20 of the skirt 19 supports the egg holder on a table or other surface. A central receptacle or bowl-shaped depression 21 is formed in the center of the holder for catching any yolk which may be spilled from a cracked or improperly cut egg, and for providing a place to mix the white of the egg and the yolk with butter, salt and pepper, if desired, for eating.

Additionally, V-shaped channels or notches 22,23 and 24,25 are formed in one side of the egg holding depressions 13,14 and 15,16, respectively, and communicate with the bowl-shaped depression 21, whereby any spilled yolk or the like will flow into the depression 21, from which the yolk may be eaten.

It should be noted that the annular surface 12 tapers slightly toward the center depression 21, whereby spilled yolk and the like flows into the depression. Also, the bowl-shaped depression 21 has a size sufficient to hold any egg spilled thereinto, or placed therein for eating.

A slot 26 is formed in the side wall 19 of the base, adjacent the annular top wall 12 thereof, for receiving one leg of a U-shaped clip or bracket 27, which has a pair of spring-like egg holding arms 28 thereon for engaging and firmly holding an egg while it is being cut.

In those forms of the invention where the clip 27 is not used, or where the opening 26 for the clip is not large enough to permit adequate escape of air, small holes (not shown) may be provided in the skirt 19 at the upper edge thereof, or in the upper surface 12, to permit air to escape from beneath the holder when it is placed in a sink or the like to be washed.

The egg cutting board could have more than two pairs of depressions therein, and other suitable means for supporting the egg rather than the projections 17 and 18 could be provided, if desired, such as an egg-shaped depression, for example. Moreover, the egg cutting board could be made from a solid block of wood or other suitable material or molded or stamped from a continuous sheet of metal, plastic or other suitable material, as desired, and could have other shapes than that shown, i.e., oval, rectangular, etc.

Thus, with the present invention an egg can be removed from boiling water with a spoon or other utensil and placed on the egg cutting board in supported relationship on the projections 15, and the egg can then be cut with a sharp knife or the like, whereby the opposite end halves thereof will fall into the respective egg-sized depressions or sockets 13,14 and 15,16 in an upright position, with little or no loss of yolk. With the invention the egg will not roll around and it is not necessary to grip the egg with the fingers, which could be difficult to do if the egg is hot. Moreover, the yolk which is spilled will flow into the center depression 21, from which the yolk may be eaten. Also, the interior of the eggs may be removed from the shells and placed in the central bowl for mixing and eating.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A utensil for holding boiled eggs while they are cut and eaten, comprises a base having an upper surface with at least one pair of adjacent depressions therein each having a size and shape to receive and hold therein one end half of an egg, egg supporting means on the upper surface between the depressions of the pair for supporting an egg while it is cut and wherein the portions of the cut egg will fall into the respective depressions, and a generally bowl-shaped depression in the upper surface adjacent the egg receiving depressions for catching any yolk which is spilled, whereby the yolk may be eaten, and whereby the egg yolk and egg white may be mixed with salt, pepper, butter or the like prior to eating.

2. A utensil as in claim 1, wherein channels are formed in the upper surface, extending from the egg receiving depressions into the bowl-shaped depression, whereby any egg which is spilled can flow into the blow-shaped depression.

3. A utensil as in claim 1, wherein the upper surface is annular and surrounds the bowl-shaped depression.

4. A utensil as in claim 3, wherein the annular surface is tapered toward the bowl-shaped depression to facilitate flow of spilled egg into the bowl-shaped depression.

5. A utensil as in claim 1, wherein the utensil comprises a one-piece molded plastic member.

6. A utensil as in claim 1, wherein the egg supporting means comprises a plurality of upstanding projections which engage the side of an egg to support it to be cut.

* * * * *